United States Patent [19]

Levorchick et al.

[11] Patent Number: 5,029,797

[45] Date of Patent: Jul. 9, 1991

[54] PLAYING CARD HOLDER

[75] Inventors: Joseph Levorchick; Gregory N. Levorchick, both of San Diego, Calif.

[73] Assignee: Gregory N. Levorchick, San Diego, Calif.

[21] Appl. No.: 515,326

[22] Filed: Apr. 26, 1990

Related U.S. Application Data

[63] Continuation of Ser. No. 409,129, Sep. 19, 1989, abandoned.

[51] Int. Cl.[5] ..... A47B 97/04

[52] U.S. Cl. ..... 248/459; 273/150

[58] Field of Search ..... 248/459, 174, 460, 165; 40/152.1, 124.2, 124.4, 122, 120; 273/150

[56] References Cited

U.S. PATENT DOCUMENTS

| | | | |
|---|---|---|---|
| 740,615 | 10/1903 | Benedict | 24/101 R |
| 805,895 | 11/1905 | Wedderburn | 273/150 |
| 1,368,859 | 2/1921 | Styll | 248/459 |
| 1,410,959 | 3/1922 | Ritter . | |
| 1,426,883 | 8/1922 | Lerner | 24/101 R X |
| 1,508,082 | 9/1924 | Boeppler . | |
| 2,035,031 | 3/1936 | Koczian | 24/101 R X |
| 2,400,296 | 5/1946 | Jacobs | 273/150 X |
| 2,772,886 | 12/1956 | Parmele . | |
| 3,323,801 | 6/1967 | Babcock . | |
| 3,370,368 | 2/1968 | Paschal | 248/459 |
| 3,818,905 | 6/1974 | Lebold | 273/150 X |
| 4,266,771 | 5/1981 | Carbone et al. . | |
| 4,318,471 | 3/1982 | Hutton | 248/459 X |
| 4,651,872 | 3/1987 | Joyce | 40/124.2 X |
| 4,736,853 | 4/1988 | O'Mara | 248/206.5 X |

FOREIGN PATENT DOCUMENTS

| | | |
|---|---|---|
| 196700 | 12/1961 | Sweden . |
| 1603451 | 11/1981 | United Kingdom . |

*Primary Examiner*—J. Franklin Foss

*Attorney, Agent, or Firm*—Knobbe, Martens, Olson & Bear

[57] ABSTRACT

A compact, portable card holder for holding a hand of playing cards in a displayed position to one or more players is provided. The holder consists of a polyhedron formed of a series of hinged panels, with a fastening system provided that selectively secures the holder in both the polyhedral display configuration as well as when collapsed to a compact configuration. When in this latter configuration, the card holder may be compactly and comfortably carried and/or stored by the user thereof.

5 Claims, 2 Drawing Sheets

PLAYING CARD HOLDER

This application is a continuation of application Ser. No. 409,129, filed 9-19-89, now abandoned.

BACKGROUND OF THE INVENTION

1. Field of the Invention

The present invention relates to an accessory used with playing cards, and more particularly to a self-supporting playing card holder that may be selectively folded to a collapsed, more portable structure.

2. Description of the Prior Art

The origin of playing cards is the subject of several competing theories, although an origin in China sometime between the seventh and tenth centuries is presently the most widely supported. Introduction to Europe followed in the latter half of the thirteenth century, with playing cards first reaching America with Columbus, and becoming firmly established with the arrival of the English, French, and Dutch colonists.

However introduced, playing cards and card games have proven to be extremely popular with all social classes. There in fact have been periods of time when card playing has been condemned by both governments and churches, in response to "gaming fevers" and their attendant reckless wagering practices and cruelly strict codes of honor. In more modern times, the social and intellectual prestige of games such as contract bridge, combined with the dwindling practice of gambling, have considerably lessened the legal and moral objections to card playing.

Whether by rank or combination, virtually all of the modern card games require players to place the playing cards in an organized pattern, according to the specific game rules. Further, in most games a player's cards are known only to that player, until exposed in conformity with the rules of that particular game. This secrecy requires the player to manage the playing cards in a manner that permits ready access to the cards during the play of the game, yet visually restricts other players from prematurely learning the value of the playing card holdings. The traditional manner of accomplishing these tasks is for the player to hold the cards in one hand, with the card values made visible to the player by the technique of carefully overlapping the card edges. For card games using more than one card deck, or for players suffering from an impaired functionality of the hands due to age or disease, it becomes increasingly difficult to manage one's hand of playing cards.

A number of solutions have been proposed to permit the display of a player's cards without disclosure to the other game participants. In Carbone, et al., (U.S. Pat. No. 4,266,771), a flexible playing card rack is provided, having an elongated container with a narrow opening therein to permit the partial insertion of the playing cards. A pouch is provided by the card table cover of Parmele, (U.S. Pat. No. 2,772,886), and it provides ample room to distribute a hand of playing cards along one side of a card table. This distributional space is obtained at the cost of portability.

The card holders of Boeppler (U.S. Pat. No. 1,508,082), Wedderburn (U.S. Pat. No. 805,895), and Ritter (U.S. Pat. No. 1,410,959) all may be collapsed into a more personal-sized structure for ease in transport and storage. The Mah Jongg playing-tile support of Boeppler is formed by folding a rectangular sheet of fibrous material, such as cardboard, along longitudinal score lines. Wedderburn and Ritter also make use of score lines, however, unlike the inserted tab supports used by Boeppler, Wedderburn and Ritter rely upon specialized structures formed in the holder to maintain the holder in its deployed position, (longitudinal ribs "C" in Wedderburn and the stay 11 in Ritter). The structures designed to hold and display the playing cards, (or tiles), range from the ledge of Boeppler and Wedderburn to the "pocket" of Ritter, Carbone, et al., and Parmele.

These various playing card holders are manufactured out of material that is sturdy, yet inexpensive, for example the cardboard of Ritter and the hard plastic of Carbone, et al. Additionally, the majority of the card holders call for a flexible or foldable structure, with a few having multiple panels that may be folded in a certain manner to form the playing card stand, such as the triangular tile-holder of Boeppler. However, while hinged cardboard panels and flaps to retain playing cards have been available, such as shown in Ritter, their compactness when collapsed leaves a great deal to be desired. A bulky holder is inconvenient to be carried around by the card player. Additionally, besides not folding into a compact configuration, the holders of Wedderburn, Boeppler and Babcock have no mechanism to maintain the holder in its collapsed configuration.

SUMMARY OF THE INVENTION

The present invention has as an underlying objective the improvement in the previously known playing card holders by arranging fastening mechanisms on a collapsible holder in a manner that provides positive securement of the holder, both when set up as a playing card holder and when collapsed for storage.

This goal is inventively achieved by providing a scored, sheet-form substrate, having the score-lines placed in a manner that permits the sheet-form substrate to be folded into a polyhedron. The folded shape is preferably such that both a stable platform and a surface upon which to display the cards is formed, for example, a triangular prism. The display surface may also be provided with a flap of sheet material attached to the surface in a manner that enables the playing cards to be temporarily received and retained between the sheet material and the polyhedron surface during the play of the card game.

A pair of fastening systems is also attached to the scored substrate, with one fastening system used to secure the card holder when fully deployed for use as a card holder during a card game, and the other fastening system used to secure the holder when collapsed for transport and storage. Preferably these fastening systems are of the two-part, cooperative variety, with the individual components of the fastening system selectively placed upon the surface of the substrate in a manner that causes the complimentary pairs to interact and fasten only when the card holder is placed in the card holder configuration or when the holder is fully collapsed. The fastening system thus secures the card holder when in use during a card game and when collapsed for storage and transport.

The present invention provides a self-supporting card holder upon which a hand of cards can be displayed and maintained in a spread-out position to the player using the card holder while not being visible to other players. The present card holder invention eliminates the need to hold the cards in one's hand. This foldable, light weight card holder can also be used to hold a hand of cards in those games where "dummy" hands need to be held and displayed. Additionally, this invention provides a playing card holder that prevents a player's hand from getting muscular cramps where it is necessary for that player to hold five or more cards in a spread position over a long period of time.

Various other objects, advantages, and features of the present invention will become readily apparent from the ensuing detailed description, and the novel features will be particularly pointed out in the appended claims.

DESCRIPTION OF THE PREFERRED EMBODIMENT

Figure 1:
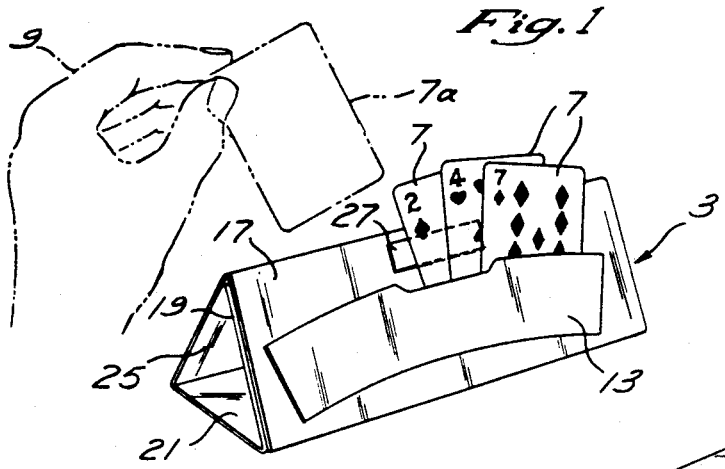
FIG. 1 is a perspective view, with portions in phantom, showing playing cards received within and displayed by a card holder in accordance with the present invention.

FIG. 1 shows a playing card holder 3 holding a plurality of playing cards 7, with a hand 9, (shown in phantom), holding a playing card 7*a*, (also in phantom), illustrating the use of the playing card holder 3 during any one of numerous card games requiring a player to retain a plurality of cards during at least one point of the particular game. The playing card 7*a* shown in phantom in FIG. 1 could be either in the process of removal from the playing card holder 3 or just prior to being placed in and retained by a card holder pocket 13 attached to a card display surface panel 17 of the playing card holder 3. An inner reinforcing panel 19 (best shown in FIG. 6) backs up the display surface panel 17, providing additional rigidity to the overall structure of the playing card holder 3, that is completed by an outer lateral support panel 25.

Although the card holder 3 may be any of various types of polyhedrons, the triangular prism depicted in FIG. 1, having an outer base support panel 21, provides a maximum amount of stability in a most simple structure. Similarly, a variety of light-weight materials would be appropriate for use in the fabricating of the playing card holder 3. At present, "24 point" chipboard is preferred, with "16 point" chipboard appropriate for use in fabricating the card holder pocket 13, with any one of various known adhesives used to attach same to the playing card holder 3. In addition, a protective coating, such as varnish, may be applied to one or both surfaces of the card holder 3.

Figure 2:
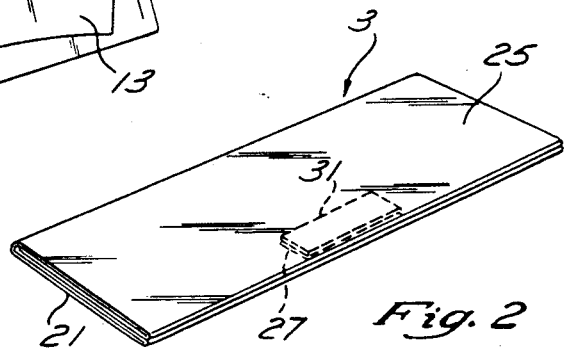
FIG. 2 is a perspective view, with portions in phantom, showing the card holder of FIG. 1 in a collapsed configuration for storage or transport.

In FIG. 2, the playing card holder 3 is in a collapsed configuration occupying considerably less volume then when fully deployed and being used as a holder for playing cards, (for example that structure shown in FIG. 1). The manner of forming the closed configuration of FIG. 2 is best described by making reference to both FIGS. 2 and 3, with FIG. 3 illustrating an intermediate structure formed during the transition between the structure of FIG. 1 and FIG. 2.

Figure 3:
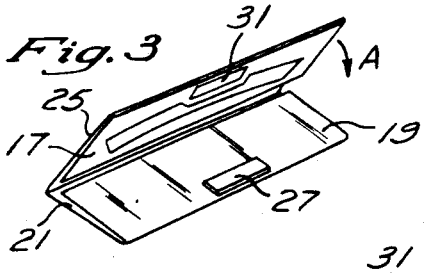
FIG. 3 is a perspective view, similar to FIG. 2, showing the playing card holder in a partially collapsed configuration, and also showing the fastening system used to retain the card holder in the configuration shown in FIG. 2.

In FIG. 3, both the card display surface panel 17 and the inner reinforcing panel 19 have been folded inwardly against the two outer panels. Although there are any number of temporary fastening systems that can be used to retain the playing card holder 3 in its deployed and in its collapsed configurations, the system illustrated in FIGS. 1–6 is a magnetic fastening system. A strip magnet 27, of the type well-known in the fastener industry, is attached to the inner reinforcing panel 19 adjacent to the base support panel 21. The strip magnet 27 is positioned on the inner reinforcing panel 19 in a manner permitting the strip magnet 27 to receive and become magnetically attached to a first ferromagnetic strip 31, such as a steel sheet metal strip, located on the card display surface panel 17, when the folded outer lateral support panel 25 and the card display surface panel 17 are folded toward the outer base support panel 21 and the inner reinforcing panels 19, in the direction of arrow A (FIG. 3). The magnetic attraction between the strip magnet 27 and the ferromagnetic strip 31 assists in maintaining the playing card holder 3 in a closed configuration, such as is illustrated in FIG. 2. The ferromagnetic strip 31 may be attached to the card display surface panel 17 using an adhesive, such as that used to attach the card holder pocket 13 to the same panel.

Figure 4:
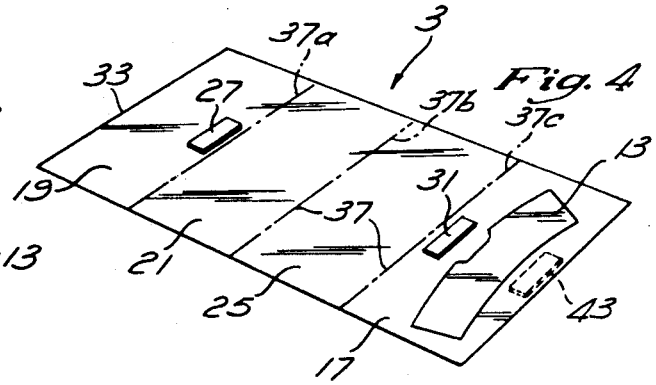
FIG. 4 is a perspective view, with portions in phantom, showing the scored, sheet-form substrate that may be configured as a playing card holder or reconfigured into a collapsed and compact form for storage and transport, in accordance with the present invention.

The playing card holder 3 is preferably fabricated out of a sheet-form material 33, such as is illustrated in FIG. 4. A plurality of fold lines 37 are formed in the sheet form material 33, thereby creating the panel structure used to create the polyhedron. When the sheet form material is plastic, the fold lines are score lines, formed in the material. Whatever the material selected, a presently preferred size for the playing card holder is $10\frac{3}{4}$ inches by $7\frac{1}{4}$ inches when spread out in the configuration of FIG. 4. In the triangular prism depicted in FIGS. 1 and 6, there are three fold lines 37 formed in the sheet form material 33, creating the four individual panel members 17, 19, 21, 25 of 2¾ inches by 7¼ inches. Preferably, the two outer panels 17, 19 may be trimmed to a width of 2⅝ inches, to facilitate the folding operations required to form the collapsed configuration of the card holder 3 shown in FIG. 2.

As is also shown by FIG. 4, a second ferromagnetic strip 43 (in phantom), is attached to the card display panel 17 on the surface opposite that of the first ferromagnetic strip 31. The second ferromagnetic strip 43 is used to stabilize the playing card holder 3 when in its card holder configuration. Such configuration is created out of the sheet-form configuration shown in FIG. 4 by manipulating the individual panels in a manner illustrated by FIG. 5. The inner reinforcing panel 19 folds towards the outer base support panel 21, along fold line 37*a*, in the direction of arrow B, with the outer base support panel 21 likewise folding toward the outer lateral support panel 25, along the fold line 37*b*, in the direction of arrow C. The card display panel 17 in turn folds toward the outer lateral support panel 25 along fold line 37*c*, in the direction of arrow D. The end result of these various folding operations is the fabrication of the playing card holder depicted in FIG. 6, wherein the interaction between the strip magnet 27 and the second ferromagnetic strip 43 magnetically fastens the inner reinforcing panel 19 to the card display panel 17.

The card holder 13, preferably consisting of a sheet-form material, is attached along a lower strip edge 47 to the card display panel 17. The playing cards 7 (not shown in FIG. 6) are releasably held between the card holder 13 and the card display panel 17 by the wedging force exerted when the playing cards 7 are inserted into and received between the card holder 13 and the card display panel 17.

Figure 6:
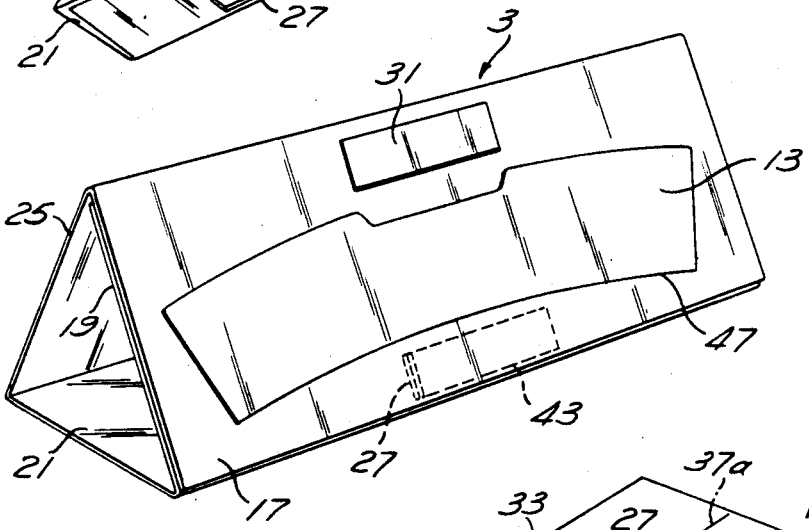
FIG. 6 is an enlarged perspective view, with portions in phantom, similar to FIG. 1, showing the playing card holder and playing card retaining flap.
Figure 5:
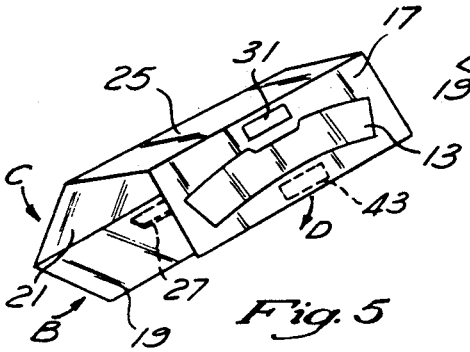
FIG. 5 is a perspective view, with portions in phantom, showing the playing card holder in transition between the configuration shown by FIG. 4 and that configuration shown by FIG. 6.
Figure 7:
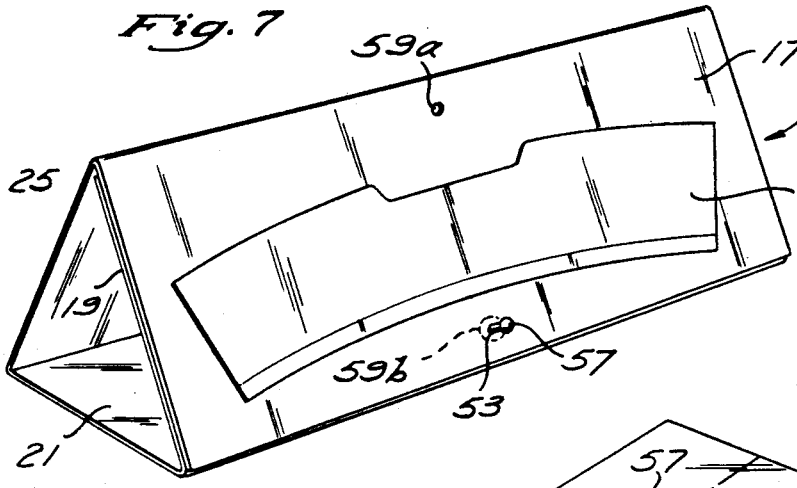
FIG. 7 is a perspective view, with portions in phantom, similar to FIG. 6, showing an alternate fastening system in the nature of a ball-pin connector.
Figure 8:
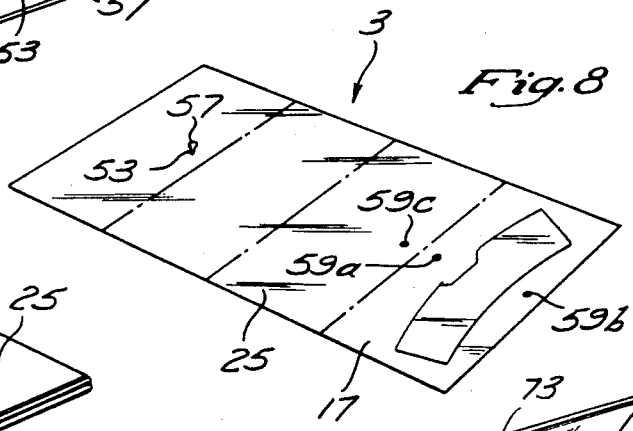
FIG. 8 is a perspective view, similar to FIG. 4, showing the scored, sheet-form substrate having the ball-pin connector of FIG. 7.
Figure 9:
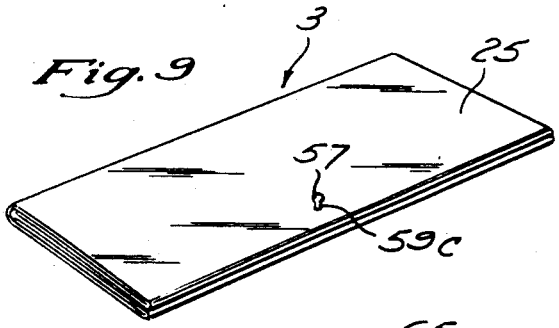
FIG. 9 is a perspective view, similar to FIG. 2, showing the collapsed configuration of a card holder using the ball-pin connector fastening system of FIGS. 7 and 8.

Of course a variety of fastening systems are available to secure the playing card holder 3 in its two configurations, and several additional fastening systems are illustrated on sheet 2 of the drawings. In FIGS. 7–9, a fastening system known as a ball-pin system is illustrated. Under such a system the strip magnet 27 of FIG. 6 is replaced by a projecting pin 53 having an enlarged tip or ball 57 formed thereon. The ferromagnetic strips 31, 43 are replaced by a pair of apertures 59*a*, 59*b* of a diameter that is sufficient to receive the pin yet is required to yield or elastically deform to enable passage of the ball 57. Unlike the magnetic system wherein only two ferromagnetic strips are required, a third aperture 59*c* is required to be formed in the outer lateral support panel 25, to enable passage of the projecting pin 53 and the ball 57 through both the card display panel 17 and the outer lateral support panel 25 when they are folded into the storage configuration shown in FIG. 9.

Figure 10:
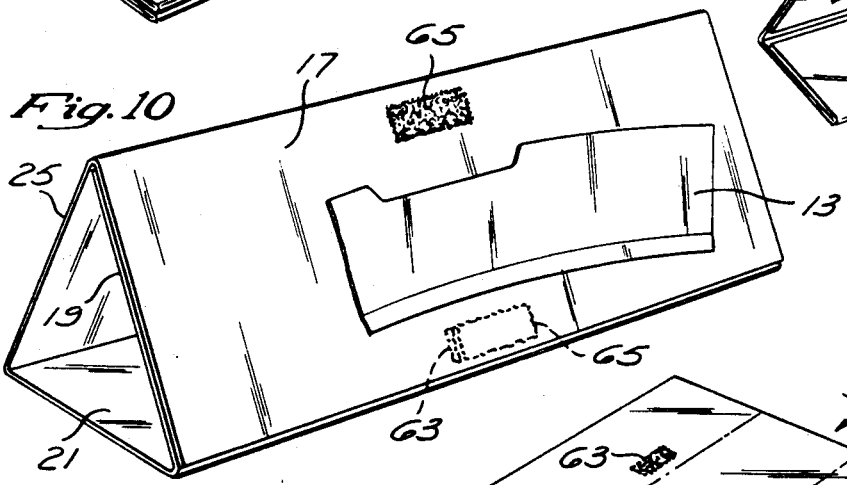
FIG. 10 is a perspective view, with portions in phantom, similar to FIGS. 6 and 7, showing an alternate fastening system in the nature of a hook-and-loop connector.
Figure 11:
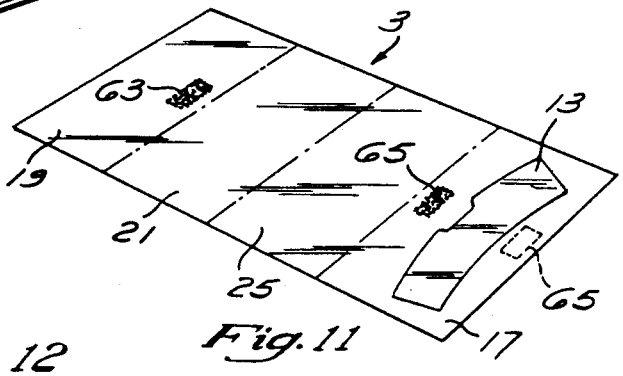
FIG. 11 is a perspective view, with portions in phantom, similar to FIGS. 4 and 8, showing the scored, sheet-form substrate having the hook-and-loop connector of FIG. 10.

FIGS. 10 and 11 illustrate usage of the hook-and-loop fastening system, such as that marketed under the trade name "VELCRO". Under this well-known fastening system, a segment of the "hook" material 63, best shown in FIG. 11, can be used in the place of the strip magnet 27, (not shown in FIGS. 10 and 11), with a pair of loop segments 65 used in the place of, and at the same location as, the first and the second ferromagnetic strips 31, 43, (which strips are not shown in FIGS. 10 and 11).

Figure 12:
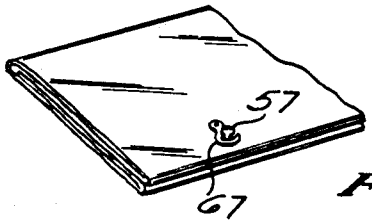
FIG. 12 is a partial perspective view, similar to FIGS. 2 and 9, showing the collapsed configuration of a card holder having a locking pin-peg fastening system.

FIG. 12 illustrates a locking pin/peg fastening system, wherein instead of the appropriately-sized apertures 59 that permit the yielding or elastic "passage" of the enlarged ball 57 used in the ball-pin fastening system illustrated in FIGS. 7–9, a peg 67 is used in conjunction with an enlarged aperture to prevent the enlarged tip or ball 57 from being inadvertently withdrawn from the aperture 59. When withdrawal is desired, the peg 67 may be pivoted from its inter-engagement with the projecting pin 53, thereby permitting the ball to once again freely pass through the aperture 59.

Figure 13:
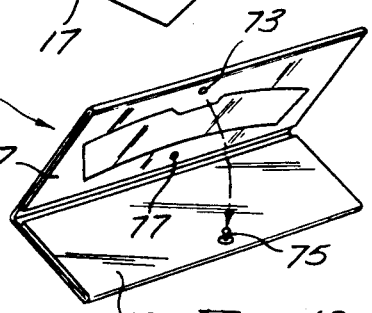
FIG. 13 is a partial perspective view, similar to FIG. 3, showing the partially collapsed configuration of a card holder having a snap fastener.

Finally, FIG. 13 illustrates a snap fastener system comprising a first female snap 73 attached to the card display panel 17 and a male snap 75 attached to the inner reinforcing panel 19. When the playing card holder 3 is completely collapsed, as shown in FIG. 12, the male and female snaps 73, 75 are positively engaged. A second female snap 77, shown in phantom, is attached to the card display panel 17 on the surface opposite that of the first female snap end 73, and engages with the male snap end 75 when the playing card holder 3 is in the triangular prism configuration (see, for example, FIG. 1).

While I have disclosed exemplary structures to illustrate the principles of the present invention, it should be understood that I wish to embody within the scope of the patent warranted hereon, all such modifications as reasonably and properly come within the scope of my contribution to the art.

What is claimed is:

1. A playing card holder, comprising:

a substantially quadrilateral sheet of semi-rigid material quadrisected by three substantially parallel score lines into four substantially equal size quadrilateral panels including a card display panel, an outer lateral support panel, an outer base support panel, and an inner reinforcing panel, wherein each panel is in a contiguous relationship with the subsequent panel as introduced herein, and wherein said sheet may be folded into a triangular prism configuration and a collapsed configuration such that said triangular prism configuration is formed by contacting an inner surface of said card display panel with an outer surface of said inner reinforcing panel so that said card holder can be used for holding cards, and said collapsed configuration is formed by contacting an inner surface of said inner reinforcing panel with an inner surface of said outer base support panel, contacting an inner surface of said card display panel with an inner surface of said outer lateral support panel, and contacting an outer surface of said inner reinforcing panel with an outer surface of said card display panel so that said card holder can be easily transported;

a pocket attached to said outer surface of said card display panel for holding playing cards; and a single, cooperating securing means comprising;

means for securing said outer surface of said card display panel to said outer surface of said inner reinforcing panel;

means for securing said inner surface of said card display panel to said outer surface of said inner reinforcing panel, and wherein said cooperating securing means includes a magnetic fastening system.

2. A playing card holder comprising:

a substantially quadrilateral sheet of semi-rigid material quadrisected by three substantially parallel score lines into four substantially equal size quadrilateral panels including a card display panel, an outer lateral support panel, an outer base support panel, an inner reinforcing panel, wherein each panel is in a contiguous relationship with the subsequent panel as introduced herein, and wherein said sheet may be folded into a triangular prism configuration and a collapsed configuration such that said triangular prism configuration is formed by contacting an inner surface of said card display panel with an outer surface of said inner reinforcing panel so that said card holder can be used for holding cards, and said collapsed configuration is formed by contacting an inner surface of said inner reinforcing panel with an inner surface of said outer base support panel, contacting an inner surface of said card display panel with an inner surface of said outer lateral support panel, and contacting an outer surface of said inner reinforcing panel with an outer surface of said card display panel so that said card holder can be easily transported;

a pocket attached to said outer surface of said card display panel for holding playing cards; and a single, cooperating securing means comprising;

means for securing said outer surface of said card display panel to said outer surface of said inner reinforcing panel; and means for securing said inner surface of said card display panel to said outer surface of said inner reinforcing panel, wherein said cooperating securing means includes a ball-pin fastening system.

3. A playing card holder, comprising:

a substantially quadrilateral sheet of semi-rigid material quadrisected by three substantially parallel score lines into four substantially equal size quadrilateral panels including a card display panel, an outer lateral support panel, an outer base support panel, and an inner reinforcing panel, wherein each panel is in a contiguous relationship with the subsequent panel as introduced herein, and wherein said sheet may be folded into a triangular prism configuration and a collapsed configuration such that said triangular prism configuration is formed by contacting an inner surface of said card display panel with an outer surface of said inner reinforcing panel so that said card holder can be used for holding cards, and said collapsed configuration is formed by contacting an inner surface of said inner reinforcing panel with an inner surface of said outer base support panel, contacting an inner surface of said card display panel with an inner surface of said outer lateral support panel, and contacting an outer surface of said inner reinforcing panel with an outer surface of said card display panel so that said card holder can be easily transported;

a pocket attached to said outer surface of said card display panel for holding playing cards; and a single, cooperating securing means comprising;

means for securing said outer surface of said card display panel to said outer surface of said inner reinforcing panel;

means for securing said inner surface of said card display panel to said outer surface of said inner reinforcing panel, and wherein said cooperating securing means includes a hook and loop fastening system.

4. A playing card holder comprising:

a substantially quadrilateral sheet of semi-rigid material quadrisected by three substantially parallel score lines into four substantially equal size quadrilateral panels including a card display panel, an outer lateral support panel, an outer base support panel, and an inner reinforcing panel, wherein each panel is in a contiguous relationship with the subsequent panel as introduced herein, and wherein said sheet may be folded into a triangular prism configuration and a collapsed configuration such that said triangular prism configuration is formed by contacting an inner surface of said card display panel with an outer surface of said inner reinforcing panel so that said card holder can be used for holding cards, and said collapsed configuration is formed by contacting an inner surface of said inner reinforcing panel with an inner surface of said outer base support panel, contacting an inner surface of said card display panel with an inner surface of said outer lateral support panel, and contacting an outer surface of said inner reinforcing panel with an outer surface of said card display panel so that said card holder can be easily transported;

a pocket attached to said outer surface of said card display panel for holding playing cards; and a single, cooperating securing means comprising;

means for securing said outer surface of said card display panel to said outer surface of said inner reinforcing panel;

means for securing said inner surface of said card display panel to said outer surface of said inner reinforcing panel, and wherein said cooperating securing means includes a locking pin/peg fastening system.

5. A playing card holder comprising:

a substantially quadrilateral sheet of semi-rigid material quadrisected by three substantially parallel score lines into four substantially equal size quadrilateral panels including a card display panel, an outer lateral support panel, an outer base support panel, and an inner reinforcing panel, wherein each panel is in a contiguous relationship with the subsequent panel as introduced herein, and wherein said sheet may be folded into a triangular prism configuration and a collapsed configuration such that said triangular prism configuration is formed by contacting an inner surface of said card display panel with an outer surface of said inner reinforcing panel so that said card holder can be used for holding cards, and said collapsed configuration is formed by contacting an inner surface of said inner reinforcing panel with an inner surface of said outer base support panel, contacting an inner surface of said card display panel with an inner surface of said outer lateral support panel, and contacting an outer surface of said inner reinforcing panel with an outer surface of said card display panel so that said card holder can be easily transported;

a pocket attached to said outer surface of said card display panel for holding playing cards; and a single, cooperating securing means comprising;

means for securing said outer surface of said card display panel to said outer surface of said inner reinforcing panel;

means for securing said inner surface of said card display panel to said outer surface of said inner reinforcing panel, and wherein said cooperating securing means includes a snap fastening system.

* * * * *